United States Patent [19]

Hooten

[11] Patent Number: 4,573,219

[45] Date of Patent: Mar. 4, 1986

[54] NECKTIE KNOT SIMULATOR

[76] Inventor: Howard G. Hooten, Indian Hill Dr., P.O. Box 288, Dewey, Ariz. 86327

[21] Appl. No.: 740,812

[22] Filed: Jun. 3, 1985

[51] Int. Cl.[4] ..... A41D 25/08; A41D 25/04

[52] U.S. Cl. ..... 2/152 R; 2/153; 24/495

[58] Field of Search ..... 2/152 R, 145, 152 A, 2/153, 156; 24/495

[56] References Cited

U.S. PATENT DOCUMENTS 2,714,719 8/1955 Peake ..... 2/153
2,896,217 7/1959 Cedarstoff ..... 24/495
3,745,614 7/1973 Tsang ..... 2/152

FOREIGN PATENT DOCUMENTS 479182 12/1951 Canada ..... 2/153
866941 5/1961 United Kingdom ..... 2/153

*Primary Examiner*—Louis K. Rimrodt
*Assistant Examiner*—Joseph S. Machuga
*Attorney, Agent, or Firm*—Drummond & Nissle

[57] ABSTRACT

A necktie knot simulator. The knot simulator is adapted to be slidably positioned along a necktie and to fixedly detachably engage a portion of the necktie to maintain the knot simulator in the desired position on the tie.

1 Claim, 8 Drawing Figures

NECKTIE KNOT SIMULATOR

This invention relates to a four-in-hand necktie knot simulator.

More specifically, the invention concerns a knot simulator which enables a wearer to arrange a four-in-hand necktie in normal wearing position without tying a knot therin.

In another respect, the invention concerns a knot simulator which permits the portion of a necktie around and adjacent the neck of a wearer to be readily loosened and tightened without subjecting the tie to wear and wrinkling normally induced by tying a conventional four-in-hand knot.

In yet a further respect, the invention concerns a knot simulator adapted to be slidably positioned along a necktie and to fixedly detachably engage a portion of the necktie to maintain the knot simulator in a desired position on the tie.

In still another respect, the invention concerns a necktie knot simulator which permits the ready arrangement of the free ends of a tie with respect to one another without requiring removal of the tie from around the neck of the wearer.

Tying a knot in a four-in-hand tie requires some minimal skill, is often bothersome and time consuming, and, in addition, when repeated many times, often results in wear and/or wrinkling of the tie, especially when the tie is fabricated from certain materials, such as silk.

Tying a knot in a tie having a non-repetitive or intricate pattern is especially difficult since the free ends of the tie must be arranged rather precisely before tying the knot so that the knot will not interrupt the pattern in an aesthically unpleasing manner.

Knot simulators for conventional four-in-hand neckties are well known in the art. See, for example, U.S. Pat. Nos. 2,936,462 to Williams, Jr., 2,943,331 to Toplansky, also 3,060,448 to Mongelli and 4,318,189 to Intengan. Such simulators often produce wrinkles on a tie or do not permit the ready adjustment of the free ends of a tie without producing wear in the tie. In addition, such simulators often do not cause intermediate portions of a four-in-hand necktie to emerge from the simulator in the arcuate overlapping fashion of a conventional four-in-one necktie knot.

Accordingly, it would be highly desirable to provide a simple means for simulating the appearance of a normal four-in-hand necktie knot without performing the normal complicated manipulative steps of actually tying the knot and by means which do not result in undue wear or wrinkling of the tie. It would be especially advantageous to provide a knot simulator which can be quickly and conveniently utilized with a conventional four-in-hand necktie in such a manner that the relative position of the free ends of the tie can be readily positioned with respect to one another and such that the portion of a necktie around and adjacent the neck of a wearer can be readily loosened and tightened without subjecting the tie to wear and wrinkling normally induced by tying a conventional four-in-hand knot.

These and other, further and more specific objects and advantages of the invention will be apparent to those skilled in the art from the following detailed description thereof, taken in conjunction with the drawings, in which.

Figure 1:
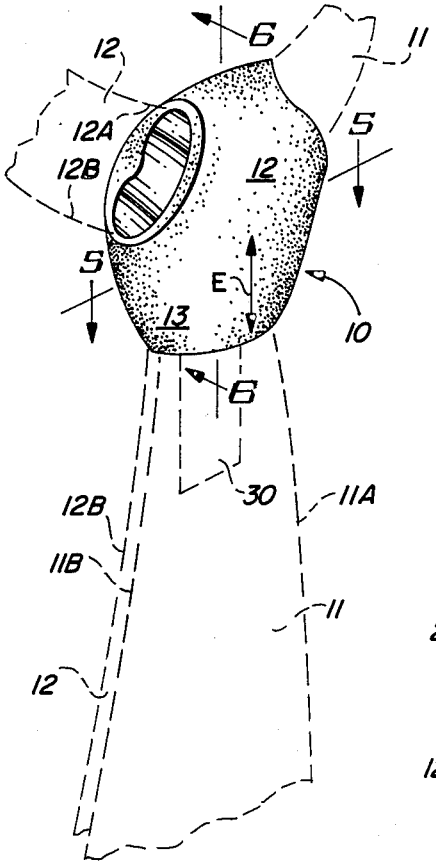
FIG. 1 is a perspective view of a necktie knot simulator constructed in accordance with the principles of the invention.

Briefly, in accordance with my invention, I provide an improved necktie knot simulator for a four-in-hand necktie, the necktie comprising an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing the free ends to extend downwardly therefrom in overlapped relationship. The improved knot simulator comprises a body in the general shape of an inverted, truncated triangle; a first arcuate channel extending through the body; and a second arcuate channel extending through the body. The body includes an upper portion; a lower portion; front, side and rear surfaces generally shaped, contoured and dimensioned such that the surfaces correspond to and simulate the front, side and rear surfaces of a four-in-hand necktie knot; first and second spaced apart generally opposed sloped shoulder surfaces on the upper portion of the body contiguous to the front, side and rear surfaces; first and second apertures formed through the first and second shoulder surfaces, respectively; and, a third aperture formed in said bottom portion of said body. The first arcuate channel extends through the body from the first aperture to the third aperture and is shaped, contoured and dimensioned to permit one of the free ends to pass therethrough such that the body can be slidably moved up and down along a first intermediate portion of the tie. A second arcuate channel extends through the body from the second aperture to the third aperture and is shaped, contoured and dimensioned to permit the other of the free ends to pass therethrough such that the body can be slidably moved up and down along a second intermediate portion of the tie. The second arcuate channel passes through the body in overlapping relationship with the first arcuate channel.

Turning now to the drawings, which depict the presently preferred embodiments of the invention for the purpose of illustrating the practice thereof and not by way of limitation of the scope of the invention, and in which identical reference characters represent corresponding elements throughout the several views, FIGS. 1 to 8 illustrate the presently preferred embodiment and best mode of the invention including a body generally indicated by reference character 10 and including front 12, side 13 and rear 14 surfaces and sloped shoulder surfaces 15, 16 formed on the upper portion of body 10.

Aperture 17 is formed in the lower portion of body 10. Channel 21 interconnects aperture 17 and surface 18 having apertures 19 and 20 formed therein. Kidney shaped apertures 22 and 23 are formed in concave surfaces 15 and 16, respectively. Continuous channel 24 extends from aperture 23 through body 10 to aperture 19.

Apertures 20 and 22 are interconnected by continuous channel 25. Channels 24 and 25 pass through body 10 in overlapping fashion and are separated by wall 27. Channels 24 and 25 taper as they pass through body 10 and the kidney-shaped curvature of each channel becomes more pronounced and arcuate as the channels approach channel 21. Accordingly, the width of the upper end of channel 25 indicated by arrows A is less than the width of the lower end of channel 25 indicated by arrows B, and the width of the upper end of channel 24 indicated by arrows C is less than the width of the lower end of channel 24 indicated by arrows D. Dimension A is greater than dimension C and dimension D is greater than dimension B. Channel 25 is sized to receive the smaller 12 of the free ends of a necktie while channel 24 is sized to receive the wider end 11 of a necktie. The kidney shaped channels 24, 25 automatically contour the free ends of 11 and 12 of the tie in arcuate fashion such that when free ends 11 and 12 pass through channels 25 and 24 into channel 21 they are in overlapped arcuate relationship similar to the relationship ends 11 and 12 are in on emerging from a conventional four-in-hand knot tied in the tie. While wall 20 separating overlapping channels 24 and 25 can be omitted, wall 20 facilitates sliding of knot simulator 10 up and down along the necktie of FIG. 1 in order to adjust the size of the tie loop encircling the neck of a wearer.

Figure 4:
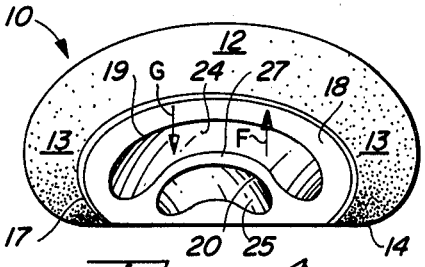
FIG. 4 is a bottom view of the necktie knot simulator of FIG. 2.

Transparent adhesive layer 30 is formed on the front surface of tie end 11. Layer 30 detachably adheres to channel 24 of simulator 10 to maintain knot simulator 10 in the desired position on the tie until the wearer grasps the simulator and necktie and moves the simulator along the tie. Adhesive layers 30 or other means for detachably engaging tie 11 with simulator 10 could also be formed on the rear surface of end 11 of the tie or one the front or rear surfaces of tie end 12. In the presently preferred embodiment of the invention, the inner surface of channel 12 is adapted such that when free end 11 is pressed against channel 21 layer 30 adheres to the surface of channel 21. Layer 30 of the end 11 is disengaged from channel 21 by pressing layer 30 away from channel 21 in the direction of arrow G (FIG. 4).

In use of the presently preferred embodiment of the invention, free ends 11 and 12 of the tie are threaded through channels 25 and 24 of knot simulator 10 and the loop formed in the tie is placed around the wearer's neck beneath the collar of a shirt. Simulator 10 is slid along the tie toward the wearer's throat to the general position shown in FIG. 1. The wearer then utilizes his fingers to press adhesive layer 30 on free end 11 in the direction of arrow F (FIG. 4) and against the surface of channel 21. The surface of channel 21 is adapted to detachably fixedly engage area 30 of tie end 11 to secure knot simulator 10 in position on the necktie. When the wearer wished to remove the tie, the wearer depresses end 11 of the tie in the direction of arrow G away from the surface of channel 21 to disengage area 30 and end 11 from channel 21. After end 11 is disengaged from channel 21, knot simulator 10 can be slid along the tie away from the throat of the wearer and the tie loop removed from the neck of the wearer.

Figure 8:
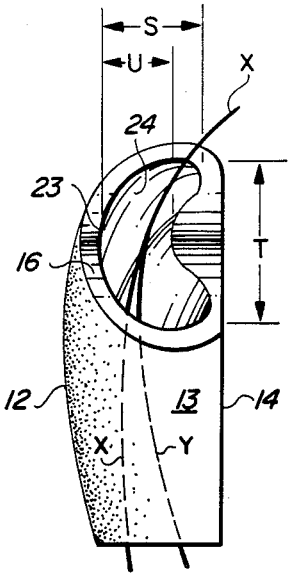
FIG. 8 is a right hand side view of the simulator of FIG. 2 further illustrating a kidney shaped aperture and arcuate channel formed therein.

The degree of curvature of a kidney shaped aperture 23 or channel 24 is generally increased by increasing dimension S in FIG. 8 while maintaining dimensions U and/or T, or by decreasing dimension T while maintaining dimensions S and/or U. The degree of curvature of a kidney shaped aperture 23 or channel 24 is generally decreased by decreasing dimension S in FIG. 8 while maintaining dimensions U and/or T, or by increasing dimension T while maintaining dimensions S and/or U.

Figure 5:
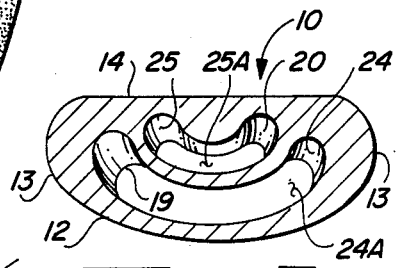
FIG. 5 is a top sectional view of the simulator of FIG. 1 taken along section line 5—5 thereof.

As described earlier, as channels 24 and 25 extend downwardly from apertures 22 and 23 through body 10 they preferably taper and have their degree of curvature increase. When channels 24 and 25 taper and have their degree of curvature increase as they extend downwardly through body 10, the degre of inward curvature of edges 11A and 11B and 12A and 12B of free ends 11 and 12 increases as the free ends extend downwardly through apertures 22 and 23, through channels 25 and 24, and into aperture 17. The cross-sectional area of each channel 24 and 25 decreases as the channels extend and taper downwardly through body 10. The cross-sectional area of the channels at a point in body 10 is illustrated in FIG. 5 and comprises the portions of inner spaces 24A and 25A of channels 24 and 25 which lie in the plane of the sheet of paper of the drawings.

Channels 24 and 25 can, instead of being kidney shaped, be oval or circular in shape. The kidney shape of the channels facilitates shaping of free ends 11 and 12 as they pass through channels 25, 24. If channels 24, 25 are circular or oval, edges 11A and 11B of a free end 11 of a tie sometimes overlap and wrinkle when passing through a channel 24.

Figure 2:
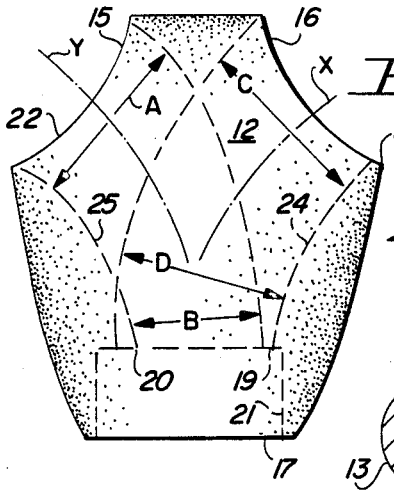
FIG. 2 is a front elevation view of the necktie knot simulator of FIG. 1.
Figure 6:
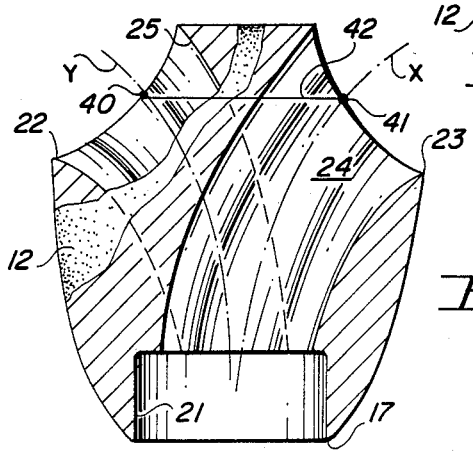
FIG. 6 is a front sectional view of the simulator of FIG. 1 taken along section line 6—6 thereof.
Figure 3:
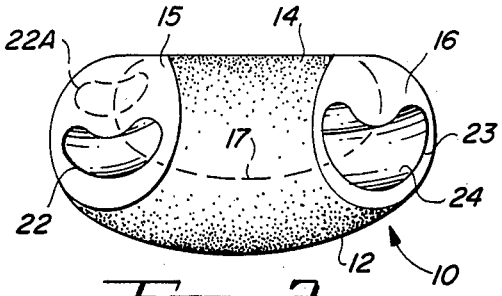
FIG. 3 is a top view of the necktie knot simulator of FIG. 3 further illustrating construction details thereof.
Figure 7:
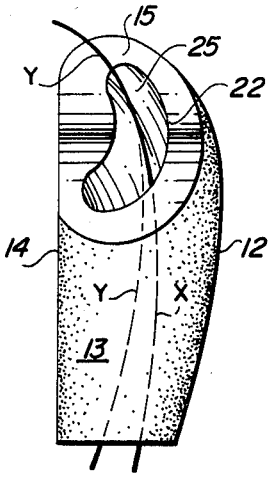
FIG. 7 is a left hand side view of the simulator of FIG. 2.

In FIGS. 2, 6 and 7 dashed lines X and Y represent the centerlines of channels 24 and 25. As shown in FIGS. 7 and 8, centerlines X and Y and channels 24 and 25 curve rearwardly as they pass downwardly through body 10 of the knot simulator, with channel 25 and centerline Y ending up in position behind channel 24 and centerline X in the bottom portion of body 10 of the knot simulator. This curvature of channels 24 and 25 increases the distance free ends 11 and 12 must travel to pass through body 10 and, accordingly, increases the distance over which channels 24 and 25 must properly conform free ends 11 and 12 as they pass through the knot simulator. The rearward curvature of channels 24 and 25 also tends to increase the frictional resistance of the channels to passage of the free ends 11 and 12 therethrough and to increase the tendency of the knot simulator to maintain its position on the free ends of the tie after the simulator has been slid along the free ends to a position adjacent the wearer's throat.

Channels 24, 25 can be formed through body 10 such that centerlines X and Y thereof do not have the rearward curvature shown in FIGS. 7 and 8 but instead lie in a common vertical plane. When centerlines X and Y lie in a common vertical plane they appear as vertical lines in FIGS. 7 and 8 and in FIG. 6 both completely lie in the plane of the sheet of paper of the drawings.

In the presently preferred embodiment of the invention shown in FIGS. 1–8, apertures 22 and 23 each are approximately centered in faces 15 and 16, and, consequently, in FIG. 6, points 40 and 41 on axis lines X and Y each lie in the plane of the paper sheet of the drawings and along imaginary horizontal line 42. Line 42 also lies in the plane of the paper sheet of the drawings. Apertures 22 and the upper portion of channel 25 can, in the manner indicated by dashed line 22A in FIG. 3 be rearwardly offset with respect to aperture 23 in order to facilitate the guiding by channel 25 of free end 12 to a position behind end 11 when ends 11 and 12 exit body 10 through aperture 17.

Having described my invention in such terms as to enable those skilled in the art to understand and practice it, and having identified the presently preferred embodiments thereof, I claim:

1. A knot simulator for a four-in-hand necktie, which necktie comprises an elongate strip of fabric which is normally worn by wrapping a portion of the necktie intermediate the free ends thereof around the wearer's neck under the collar of his shirt, forming a knot in the general shape of an inverted, truncated triangle in the portions of the free ends of said necktie extending just past the wearer's collar, allowing said free ends to extend downwardly therefrom in overlapped relationship, said knot simulator comprising (a) a body in the general shape of an inverted, truncated triangle and having
  (i) an upper portion,
  (ii) a lower portion,
  (iii) front, side and rear surfaces generally shaped, contoured and dimensioned such that said surfaces corresond to and simulate the front, side and rear surfaces of a four-in-hand necktie knot,
  (iv) first and second spaced apart generally opposed sloped shoulder surfaces on said upper portion of said body contiguous to said front, side and rear surfaces,
  (v) first and second apertures formed through said first and second shoulder surfaces, respectively, and
  (vi) a third aperture formed in said bottom portion of said body;

(b) a first arcuate channel extending through said body from said first aperture to said third aperture and shaped, contoured and dimensioned to permit one of said free ends to pass therethrough such that said body can be slidably moved up and down along a first intermediate portion of said tie; and, (c) a second arcuate channel extending through said body from said second aperture to said third aperture and shaped, contoured and dimensioned to permit the other of said free ends to pass therethrough such that said body can be slidably moved up and down along a second intermediate portion of said tie, said second arcuate channel passing through said body in overlapping relationship with said first arcuate channel.

* * * * *